US007755593B2

(12) United States Patent
Yamamoto et al.

(10) Patent No.: US 7,755,593 B2
(45) Date of Patent: Jul. 13, 2010

(54) DISPLAY DEVICE, METHOD OF CONTROLLING SAME, COMPUTER PROGRAM FOR CONTROLLING SAME, AND COMPUTER PROGRAM STORAGE MEDIUM

(75) Inventors: Takeshi Yamamoto, Soraku-gun (JP); Aki Miake, Nara (JP); Toshiya Takahashi, Soraku-gun (JP); Megumi Itoh, Nara (JP); Mitsukazu Okuda, Ikoma (JP); Takeshi Doi, Kashiwara (JP)

(73) Assignee: Sharp Kabushiki Kaisha, Osaka (JP)

( * ) Notice: Subject to any disclaimer, the term of this patent is extended or adjusted under 35 U.S.C. 154(b) by 902 days.

(21) Appl. No.: 10/598,102

(22) PCT Filed: Feb. 15, 2005

(86) PCT No.: PCT/JP2005/002684

§ 371 (c)(1),
(2), (4) Date: Aug. 17, 2006

(87) PCT Pub. No.: WO2005/085007

PCT Pub. Date: Sep. 15, 2005

(65) Prior Publication Data

US 2007/0159410 A1 Jul. 12, 2007

(30) Foreign Application Priority Data

Feb. 20, 2004 (JP) ..... 2004-045460

(51) Int. Cl.
*G09G 3/36* (2006.01)
*G09G 5/00* (2006.01)

(52) U.S. Cl. ..... 345/102; 345/1.1; 345/1.3

(58) Field of Classification Search ..... 345/1.3, 345/690, 207, 1.1, 102; 340/425.5
See application file for complete search history.

(56) References Cited

U.S. PATENT DOCUMENTS 4,581,640 A * 4/1986 Cole ..... 348/389.1

(Continued)

FOREIGN PATENT DOCUMENTS

EP 1 136 977 A2 9/2001

(Continued)

OTHER PUBLICATIONS

International Search Report issued in the corresponding International Application No. PCT/JP2005/002684, mailed on May 31, 2005.

*Primary Examiner*—Amr Awad
*Assistant Examiner*—Ilana Spar
(74) *Attorney, Agent, or Firm*—Keating & Bennett, LLP

(57) ABSTRACT

A liquid crystal display device (100) includes mean value computing sections (9*a*, 9*b*) and an optical intensity regulation section (11). The mean value computing section (9*a*) outputs a mean luminance level (A1) for the pixels forming an image display produced in a driver seat display area (2). The mean value computing section (9*b*) outputs a mean luminance level (A2) for the pixels forming an image display produced in a front passenger seat display area (3). The optical intensity regulation section (11) controls (regulates) the output optical intensity of backlights (4*a*, 4*b*) according to the mean luminance level (A1) and the mean luminance level (A2). As a result, the luminance of the image display in the front passenger seat display area (3) is further limited than the luminance of the image display in the driver seat display area (2). The control ensures high visibility of image displays for the driver.

3 Claims, 8 Drawing Sheets

U.S. PATENT DOCUMENTS

| | | | | |
|---|---|---|---|---|
| 5,440,322 | A * | 8/1995 | Prince et al. | 345/58 |
| 5,771,039 | A * | 6/1998 | Ditzik | 345/178 |
| 6,188,380 | B1 * | 2/2001 | Kawashima et al. | 345/102 |
| 6,812,907 | B1 * | 11/2004 | Gennetten et al. | 345/1.3 |
| 2002/0075136 | A1 * | 6/2002 | Nakaji et al. | 340/425.5 |
| 2003/0007227 | A1 * | 1/2003 | Ogino | 359/227 |
| 2004/0014488 | A1 * | 1/2004 | Sawayama et al. | 455/550.1 |

FOREIGN PATENT DOCUMENTS

| | | | |
|---|---|---|---|
| JP | 01-188178 | A | 7/1989 |
| JP | 04198983 | A * | 7/1992 |
| JP | 06-195056 | A | 7/1994 |
| JP | 11-120491 | A | 4/1999 |
| JP | 11120491 | A * | 4/1999 |
| JP | 11-281375 | A | 10/1999 |
| JP | 2001-215945 | A | 8/2001 |
| JP | 2001215945 | A * | 8/2001 |
| JP | 2002-166787 | A | 6/2002 |

* cited by examiner

DISPLAY DEVICE, METHOD OF CONTROLLING SAME, COMPUTER PROGRAM FOR CONTROLLING SAME, AND COMPUTER PROGRAM STORAGE MEDIUM

TECHNICAL FIELD

The present invention relates to display devices showing images to passengers in vehicles, aircraft, vessels, and other mode of transport.

BACKGROUND ART

Many display devices have been mounted to automobiles to show various images. The images displayed on the devices include those from a navigation system, those from an onboard audio system, those indicating driving information on the automobile (speed, traveled distance, direction, remaining amount of fuel, etc.), those from security cameras mounted around the automobile, and those from a television receiver.

A recent development is an onboard dashboard with a display screen at a large aspect ratio (elongated widthwise) extending from close to the driver seat to close to the front passenger's seat. The display screen is divided into a driver-side display area and a passenger-side display area. Different images are shown in display areas. See Japanese published patent application 6-195056/1994 (Tokukaihei 6-195056; published on Jul. 15, 1994, paragraph [0049].

The information needed by the driver (for example, the aforementioned driving-related information) is shown in the driver-side display area on the display screen. The information needed by a fellow passenger (for example, television image) is shown in the passenger-side display area on the display screen.

The display screen is thus capable of simultaneously displays of the information needed by the driver and information needed by a fellow passenger.

The display screen however has following problems. The driver-side display area, where driving-related information, etc. is being displayed in a typical situation, has relatively low luminance. Suppose that the passenger-side display area is showing a television image or movie, there are probably involved some scenes which require significantly elevated levels of luminance in the passenger-side display area. The resultant level of luminance in the passenger-side display area may be higher than that in the driver-side display area. Illumination in the passenger-side display area can be glaring relative to the driver-side display area. The driver possibly has trouble recognizing the display in the driver-side display area. So, illumination in the passenger-side display area may be a cause that disrupts driver's visibility.

The present invention, conceived in view of the problems, has an objective to provide a display device with separate display areas for images shown to the driver and those shown to a fellow passenger. The display device must be of a kind that ensures good visibility for the image shown to the driver. Other objectives are to provide a method of controlling the display device, a computer program of controlling the display device, and a computer program storage medium.

DISCLOSURE OF INVENTION

A display device in accordance with the present invention, to achieve the objectives, is characterized in that the device is a display device mounted to a mode of transport including at least a first display area and a second display area which is closer to a position of an operator than is the first display area when the display device is mounted to the mode of transport. The display device is also characterized in that the display device includes: first luminance level output means outputting a first luminance level representing luminance of an image display produced in the first display area; second luminance level output means outputting a second luminance level representing luminance of an image display produced in the second display area; and luminance limiting means correcting according to the first luminance level and the second luminance level so that the luminance of the image display produced in the first display area is further limited than the luminance of the image display produced in the second display area.

A method of controlling a display device in accordance with the present invention is characterized in that the method is a method of controlling a display device mounted to a mode of transport including at least a first display area and a second display area which is closer to a position of an operator than is the first display area when the display device is mounted to the mode of transport. The method is also characterized in that the method includes the steps of: outputting a first luminance level representing luminance of an image display produced in the first display area; outputting a second luminance level representing luminance of an image display produced in the second display area; and correcting according to the first luminance level and the second luminance level so that the luminance of the image display produced in the first display area is further limited than the luminance of the image display produced in the second display area.

The configuration or steps corrects according to the first luminance level and the second luminance level so that the luminance of the image display produced in the first display area is further limited than the luminance of the image display produced in the second display area. The correction results in illumination in the first display area no longer glaring relative to the second display area which is closer to the operator's position than is the first display area. This in turn ensures, for the operator, good visibility of the display in the second display area which is closer to the operator's position than is the first display area.

Additional objects, advantages and novel features of the invention will be set forth in part in the description which follows, and in part will become apparent to those skilled in the art upon examination of the following or may be learned by practice of the invention.

BEST MODE FOR CARRYING OUT THE INVENTION

The following will describe an embodiment of the present invention in reference to drawings.

A liquid crystal display device (display device) in accordance with the present embodiment is provided inside an automobile (mode of transport). The device shows images to both the driver in the driver seat (operator's position) and the passenger in the front passenger seat.

Figure 2:
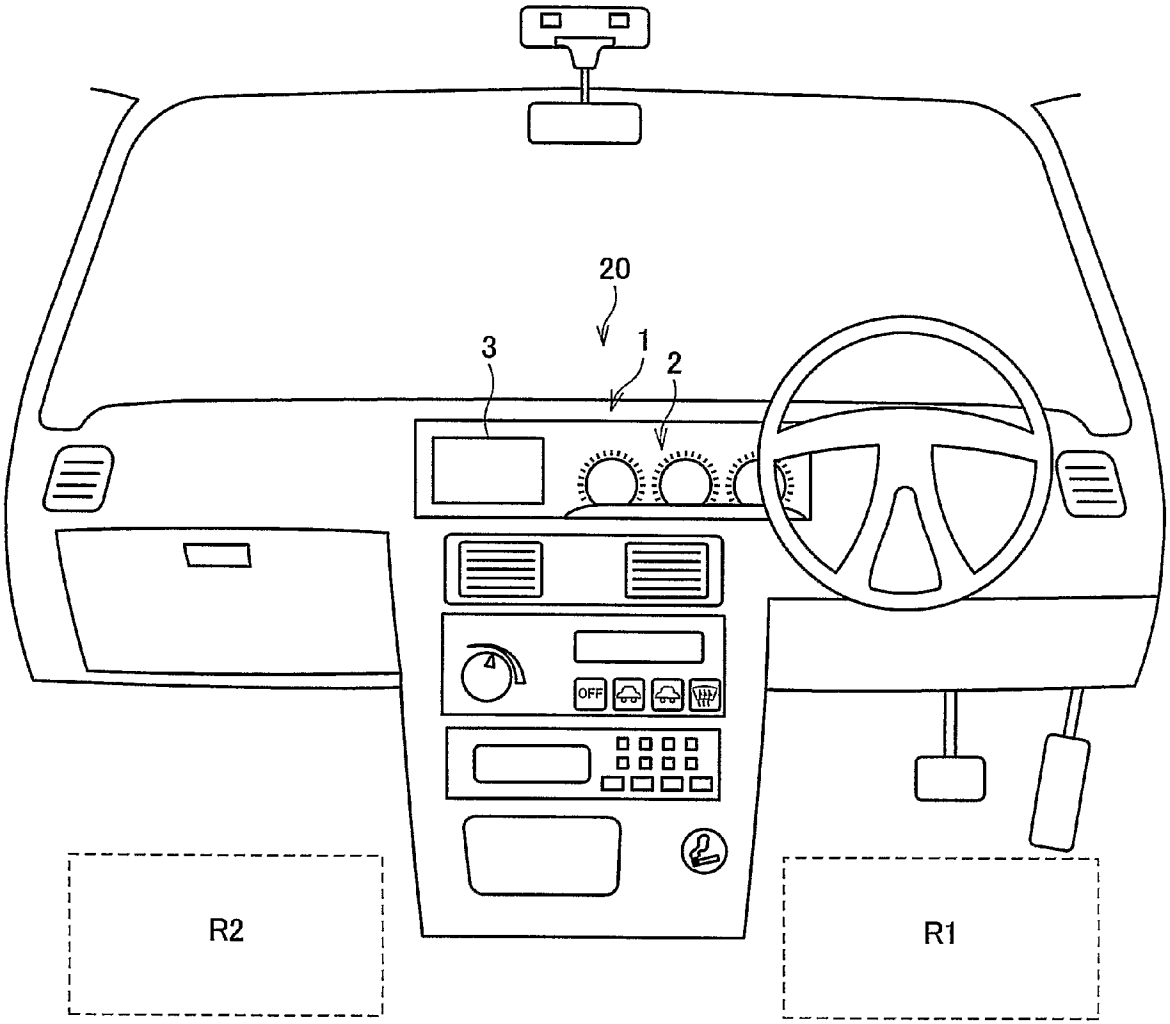
FIG. 2 is a schematic drawing illustrating the interior of an automobile equipped with a display panel in the liquid crystal display device shown in FIG. 1.

FIG. 2 is a schematic drawing illustrating the interior of an automobile equipped with the aforementioned liquid crystal display device. As shown in FIG. 2, a display panel 1, part of the liquid crystal display device, is provided near the center of a dashboard 20 of the automobile. The display panel 1 provides an extra wide display screen extending from close to a driver seat R1 to close to a front passenger seat R2. The screen has an aspect ratio, or a width/height ratio, of 7:3 or greater.

Figure 3:
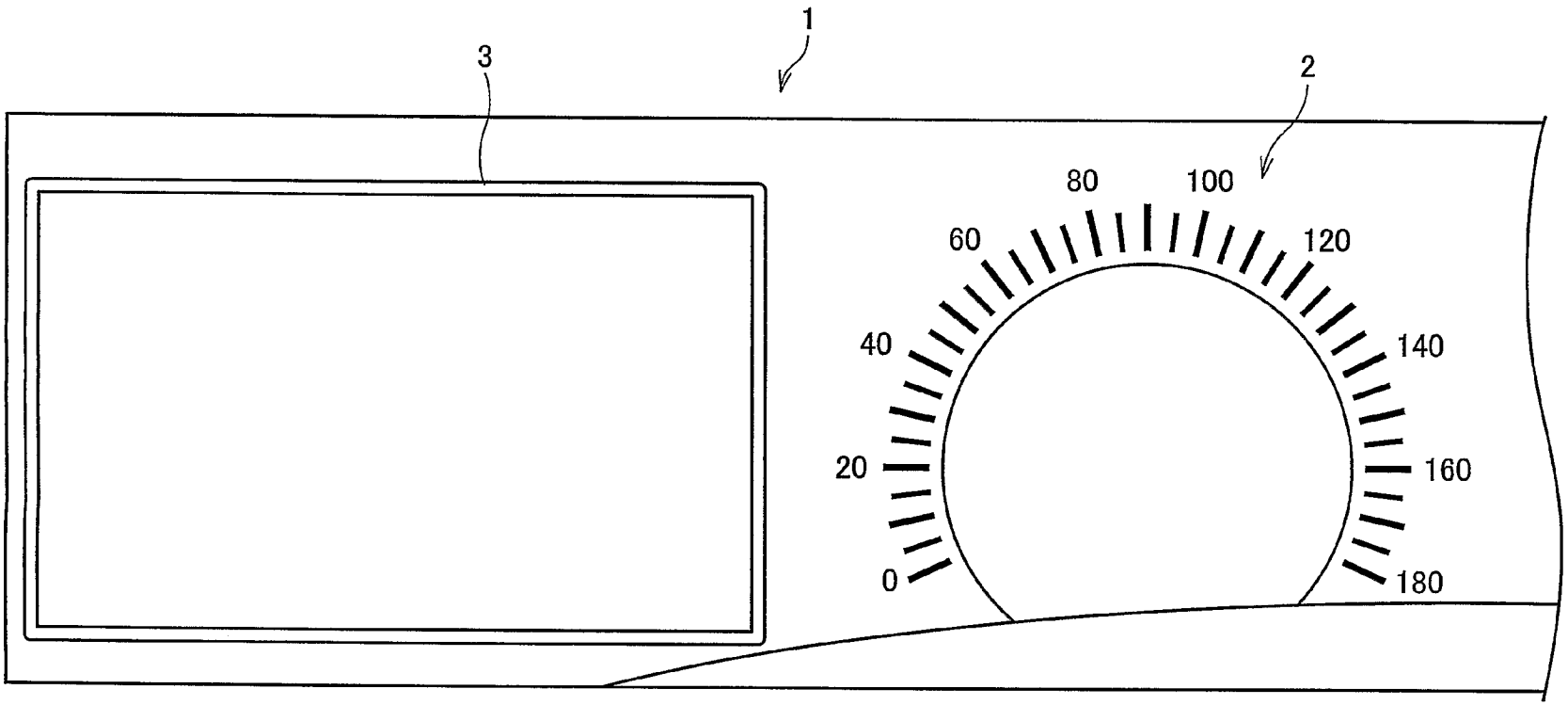
FIG. 3 is an enlarged schematic view of part of the display panel shown in FIG. 2.

FIG. 3 shows is an enlarged schematic view of part of the display panel 1 in FIG. 2. As shown in FIG. 3, the display panel 1 provides, in a single screen, a driver seat display area (second display area) 2 and a front passenger seat display area (first display area) 3. The display panel 1 is a transmissive type of liquid crystal display device. Internal to the dashboard does the display panel 1 contain separate light-supplying backlights (for example, fluorescent tubes or light-emitting diodes) for the driver seat display area 2 and the front passenger seat display area 3. The backlight for the driver seat display area 2 differs in structure from the backlight for the front passenger seat display area 3.

On the display panel 1 installed in the automobile, the driver seat display area 2 sits closer to the driver seat R1 (see FIG. 2) than is the front passenger seat display area 3. The area 2 is an area where images are shown which gives driving information on the automobile to the driver in the driver seat R1. The driving information on the automobile is kind of information that is necessary to the driver when operating the automobile: for example, speedometer, tachometer, odometer, fuel gauge, oil gauge, water thermometer, open door warning light, seatbelt warning light, and security camera images. The security cameras may be provided on the automobile to monitor the surroundings.

On the display panel 1 installed in the automobile, the front passenger seat display area 3 sits closer to the front passenger seat R2 (see FIG. 2) than is the driver seat display area 2. The area 3 is an area where fellow passenger images are shown for the fellow passenger in the front passenger seat R2. The fellow passenger images are those displayed for the fellow passenger in the front passenger seat R2: for example, images from a navigation system, an onboard audio system, and a television receiver. Examples of the navigation system images include, for example, a manipulation menu for the manipulation of the navigation system and a navigation map screen. Examples of the onboard audio system images include, for example, a manipulation menu for the manipulation of an onboard audio system and images reproduced from a DVD. The onboard audio system may be, for example, a CD (Compact Disc), MD (Mini Disc), or DVD (Digital Versatile Disc) player.

Figure 1:
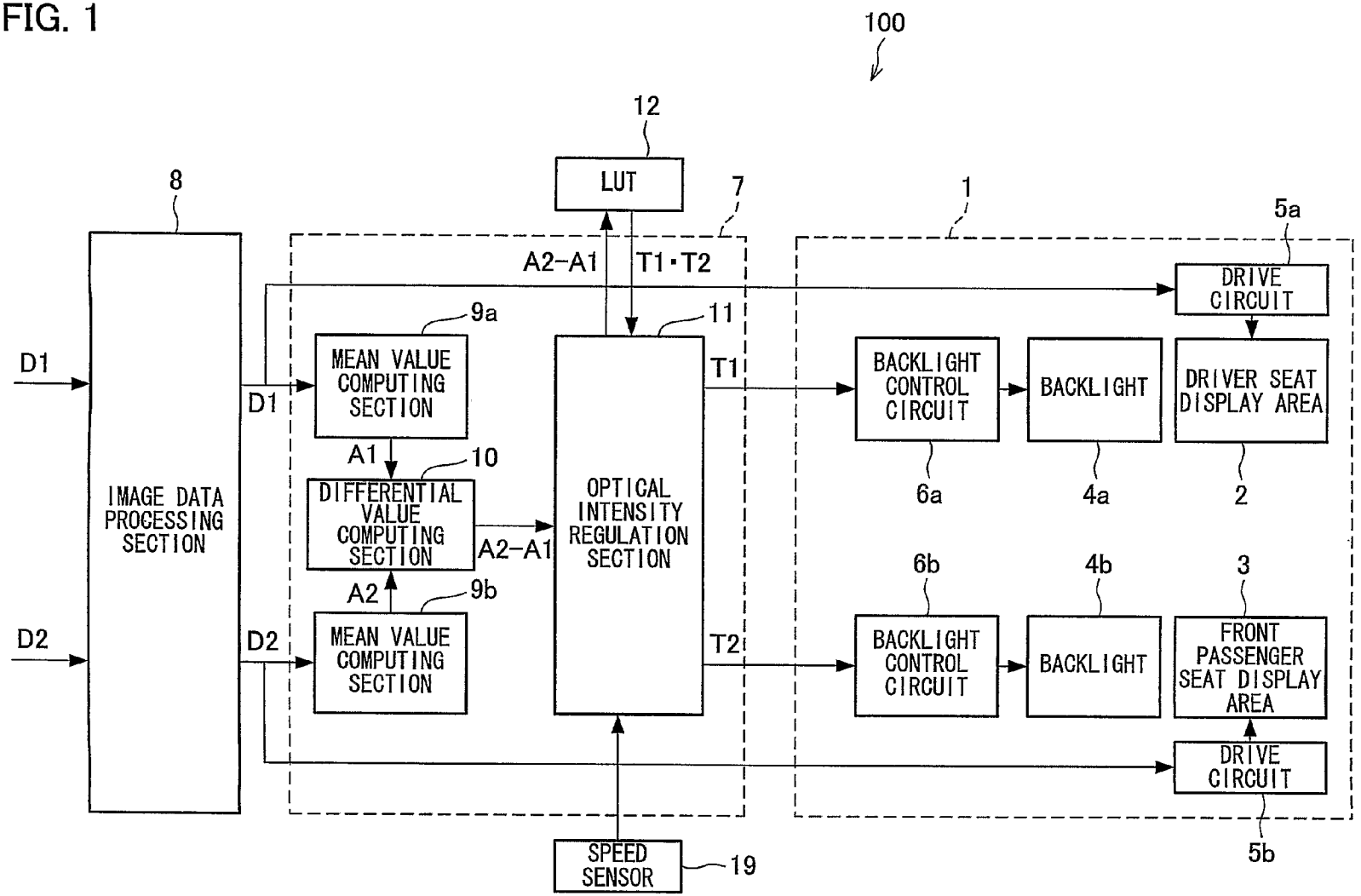
FIG. 1 is a block diagram schematically illustrating the configuration of a liquid crystal display device in accordance with an embodiment of the present invention.

Now, the configuration of the liquid crystal display device in accordance with the present embodiment will be described in more detail. FIG. 1 is a block diagram schematically illustrating the configuration of a liquid crystal display device 100 in accordance with the present embodiment. The liquid crystal display device 100 primarily includes the display panel 1, a display luminance control section 7, and an image data processing section 8.

The display panel 1 is indicated as a display area block for the liquid crystal display device 100. As mentioned earlier, the panel 1 is built around a single transmissive liquid crystal display device. The display panel 1, again as mentioned earlier, has the driver seat display area 2 and the front passenger seat display area 3. The display panel 1 also includes backlights 4*a*, 4*b*, drive circuits 5*a*, 5*b*, and backlight control circuits 6*a*, 6*b*.

The backlight 4*a* provides a light source (for example, fluorescent tube or light-emitting diode) which projects light for image display use to pixels in the driver seat display area 2. The backlight 4*b* is a light source projecting light for image display use to pixels in the front passenger seat display area 3.

The drive circuit 5*a* drives the pixels in the driver seat display area 2 according to incoming image data D1. The drive circuit 5*b* drives the pixels in the front passenger seat display area 3 according to incoming image data D2.

The backlight control circuit 6*a* is an inverter unit regulating the output optical intensity of the backlight 4*a*. The backlight control circuit 6*b* is an inverter unit regulating the output optical intensity of the backlight 4*b*.

In the display panel 1, the backlights 4*a*, 4*b* generate light, and the pixels are driven according to image data, so as to display images in the display areas according to the image data.

The display luminance control section 7 forms a block which regulates the output optical intensity of the backlights 4*a*, 4*b*. The regulation is carried out when the automobile is determined to be moving according to a result of sensing fed from a speed sensor (motion detecting means) 19. The regulation renders the luminance of the image shown in the front passenger seat display area 3 lower than that of the image shown in the driver seat display area 2. The configuration of the section 7 will be given later in detail.

The image data processing section 8 forms a block which perform gamma correction and other image processing on the image data D1, D2 fed from outside the liquid crystal display device 100. The image data D1 represents an image to be displayed in the driver seat display area 2. The image data D2 represents an image to be displayed in the front passenger seat display area 3. After the image processing on the image data D1, D2, the image data processing section 8 sends the image data D1 to the drive circuit 5*a* and the display luminance control section 7. The section 8 also sends the image data D2 to the drive circuit 5*b* and the display luminance control section 7.

Now, the configuration of the display luminance control section 7 will be described in detail. The display luminance control section 7 includes mean value computing sections 9*a*, 9*b*, differential value computing section 10, and an optical intensity regulation section 11.

The mean value computing section (second luminance level output means) 9*a* forms a block which calculates a mean luminance level (second luminance level) A1 from the image data D1 fed from the image data processing section 8. The mean luminance level A1 indicates a mean luminance across the driver seat display area 2 and is calculated from the luminance levels of the pixels forming an image display. The output of the section 9*a* is fed to the differential value computing section 10. The mean value computing section (first luminance level output means) 9*b* forms a block which calculates a mean luminance level (first luminance level) A2 from the image data D2 fed from the image data processing section 8. The mean luminance level A2 a mean luminance across the front passenger seat display area 3 and is calculated from the luminance levels of the pixels forming an image display. The output of the section 9*b* is also fed to the differential value computing section 10.

The luminance level of a pixel is given by equation (1) below. So, the mean luminance level is the average of the luminance levels of the pixels forming an image and may be considered the luminance level of the image. That is, the mean luminance level A1 may be considered the luminance level of the image display in the driver seat display area 2. The mean luminance level A2 may be considered the luminance level of the image display in the front passenger seat display area 3.

$$\text{Luminance Level}=0.299R+0.587G+0.114B \quad (1)$$

where R is a pixel value for a red component, G is a pixel value for a green component, and B is a pixel value for a blue component.

In the present embodiment, the pixel value is a red, green, or blue grayscale level of a pixel of an image. The grayscale levels are contained in the image data. Also in the present embodiment, the pixel values and luminance levels are given by 8-bit digital signals. Further in the present embodiment, luminance increases with an increase in the luminance level. Luminance levels are represented by 8-bit, 0 (black) to 255 (white) digital signals.

The differential value computing section 10 is a block which subtracts the mean luminance level A1 from the mean luminance level A2 to calculate a differential value A2-A1 for output to the optical intensity regulation section 11.

The optical intensity regulation section (luminance limiting means) 11 is a block which controls the output optical intensity of the backlights 4*a*, 4*b* when the differential value A2-A1 is positive. The section 11 refers to a LUT (Look-up Table) 12 for optical intensity regulation data T1, T2 associated with the differential value A2-A1. The section 11 supplies the optical intensity regulation data T1 to the backlight control circuit 6*a* and the optical intensity regulation data T2 to the backlight control circuit 6*b*. A positive differential value A2-A1 can be safely regarded as indicating that the luminance of the image display in the front passenger seat display area 3 is higher than the luminance of the image display in the driver seat display area 2. This is because, as mentioned earlier, the mean luminance level A1 may be considered the luminance of the image display in the driver seat display area 2, and the mean luminance level A2 is considered the luminance of the image display in the front passenger seat display area 3.

The LUT 12 records combinations of output optical intensity regulation data T1, T2 in association with input differential values A2-A1. The output combination of optical intensity regulation data T1, T2 in association with input differential values A2-A1 is a pair of an output optical intensity of the backlight 4*a* and an output optical intensity of the backlight 4*b*. The pair results in the luminance of the image display in the front passenger seat display area 3 being lower than the luminance of the image display in the driver seat display area 2 when the image display in the driver seat display area 2 is produced according to the image data D1 indicating the mean luminance level A1, and the image display in the front passenger seat display area 3 is produced according to the image data D2 indicating the mean luminance level A2. The optical intensity regulation data T1 indicates the output optical intensity of the backlight 4*a*. The optical intensity regulation data T2 indicates the output optical intensity of the backlight 4*b*. The optical intensity regulation data T1, T2 is recorded in the LUT 12 when the liquid crystal display device 100 is set up during manufacture.

Figure 4:
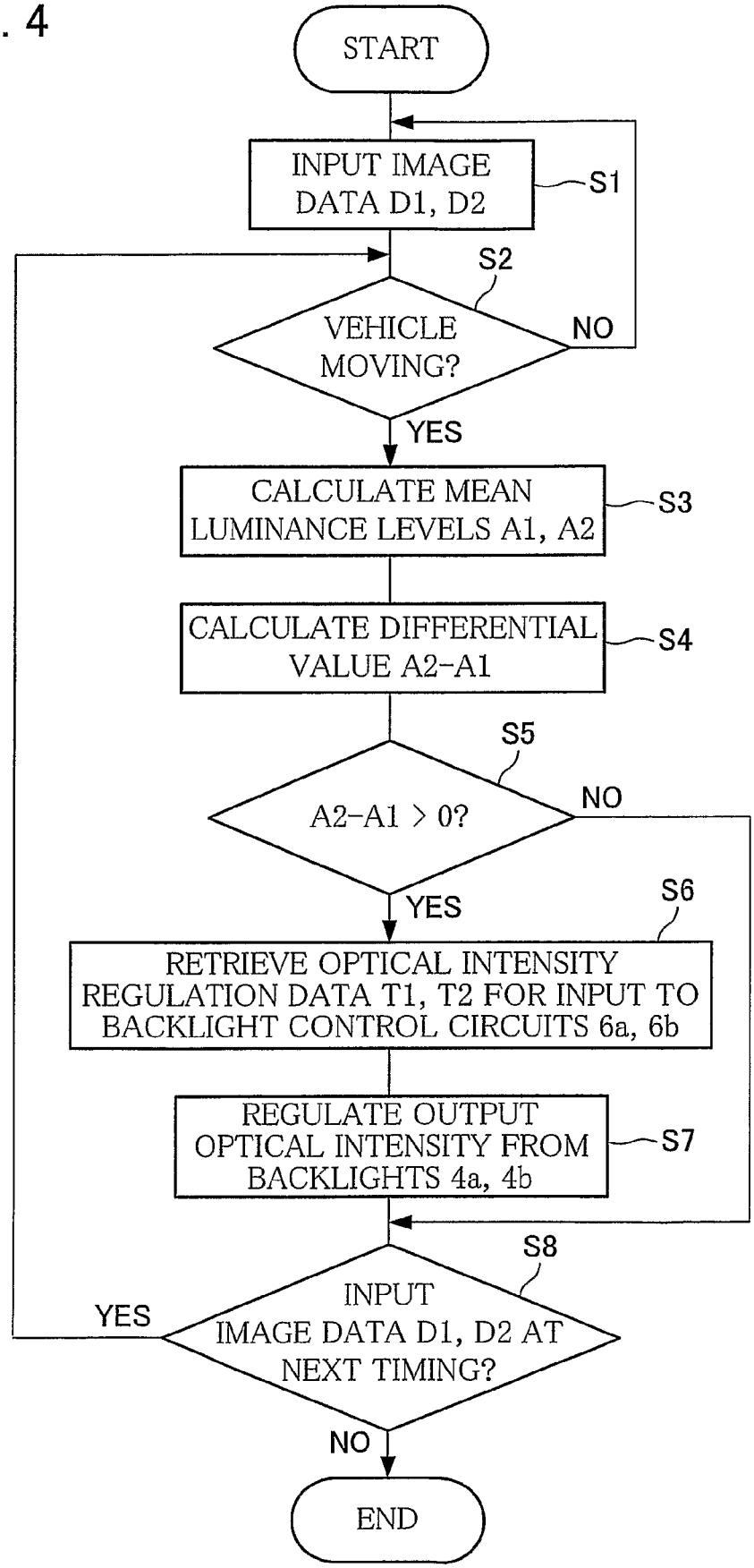
FIG. 4 is a flow chart illustrating a process flow for controlling the display luminance of the liquid crystal display device shown in FIG. 1.

Next, the flow of process by the display luminance control section 7 will be described in reference to the flow chart in FIG. 4.

First, in step 1 ("S1"), image data D1, D2 for an image display at a certain timing are fed to the image data processing section 8. Then, in S2, the display luminance control section 7, more specifically the optical intensity regulation section 11 in the section 7, determines whether the automobile is moving according to a detection signal from the speed sensor 19. If the automobile is moving (YES in S2), the display luminance control section 7 instructs the mean value computing sections 9*a*, 9*b*, the differential value computing section 10, and the optical intensity regulation section 11 to start operation. The flow then continues to S3. If the automobile is stationary (NO in S2), S1 and S2 are repeated.

In S3, the mean value computing sections 9*a*, 9*b* calculates mean luminance levels A1, A2 from the image data D1, D2 fed from the image data processing section 8. Then, in S4, the differential value computing section 10 subtracts the mean luminance level A1 from the mean luminance level A2 to calculate a differential value A2-A1. Further, in S5, the optical intensity regulation section 11 determines whether the differential value A2-A1 is positive. If the differential value A2-A1 is positive (YES in S5), the optical intensity regulation section 11 retrieves optical intensity regulation data T1, T2 from the LUT 12 in accordance with the differential value A2-A1. The section 11 supplies the optical intensity regulation data T1 to the backlight control circuit 6*a* and the optical intensity regulation data T2 to the backlight control circuit 6*b* (S6). If the differential value A2-A1 is not positive (NO in S5), the flow continues to S8.

The backlight control circuits 6*a*, 6*b* regulates the output optical intensity of the backlights 4*a*, 4*b* in accordance with the optical intensity regulation data T1, T2 (S7). In S8, it is determined whether image data D1, D2 for an image display at a next timing is coming. If there is incoming image data D1, D2 (YES in S8), S2 and its following steps are repeated. If there is no image data D1, D2 coming in (NO in S8), the display luminance control section 7 ends the processing.

As mentioned earlier, the optical intensity regulation data T1, T2 in S6, S7 indicates the output optical intensity of the backlights 4*a*, 4*b*. The data T1, T2 results in the luminance of the image display in the front passenger seat display area 3 being lower than the luminance of the image display in the driver seat display area 2 when the image display in the driver seat display area 2 is produced according to the image data D1 indicating the mean luminance level A1, and the image display in the front passenger seat display area 3 is produced according to the image data D2 indicating the mean luminance level A2.

Therefore, the luminance of the image display in the front passenger seat display area 3 can be kept lower than the luminance of the image display in the driver seat display area 2 by regulating the optical intensity of the backlights 4*a*, 4*b*, even if the mean luminance level A2 is higher than the mean luminance level A1. The mean luminance level A2 is given by the image data D2 for the image display produced in the front passenger seat display area 3. The mean luminance level A1 is given by the image data D1 for the image display produced in the driver seat display area 2.

This capability allows an automatic regulation of the luminance of the image display in the driver seat display area 2 and in the front passenger seat display area 3. The automatic regulation results in illumination in the front passenger seat display area 3 no longer glaring relative to the driver seat display area 2. This eliminates the problem that the image display in the front passenger seat display area 3 could disrupt visual recognition of the display in the driver seat display area 2.

The foregoing description assumes that the luminance of the image display in the front passenger seat display area 3 is kept lower than the luminance of the image display in the driver seat display area 2 by regulating the output optical intensity of the backlights 4*a*, 4*b* for the display areas depending on whether the automobile is moving. In this configuration, the speed sensor 19 is connected to the optical intensity regulation section 11 in the display luminance control section 7. The sensor 19 is motion detecting means detecting a motion of the automobile. The optical intensity regulation section 11 determines that the automobile is moving if the speed sensor 19 indicates an automobile speed in excess of 0 km/h. The threshold speed value for the determination may be set to any given value in excess of 0 km/h. Hence, only during driving, the device 100 retains high visibility of the image display in the driver seat display area 2 for the driver. The area 2 shows driving-related information needed during driving. At other times than when the automobile is in motion, the device 100 produces image displays in the front passenger seat display area 3 without decreasing the luminance of the front passenger seat display area 3 so that the driver and fellow passengers can recognize the images. These actions are automatically implemented by the device 100 without the passenger(s) having to be aware of any motion of the automobile or lack of such a motion.

Motion of the automobile may be detected using other motion detecting means than the aforementioned speed sensor 19. An example is a GPS (Global Positioning System)-based device. The device receives information on the position of the automobile from the GPS. A determination as to whether the automobile is moving is made based on that information.

In the above configuration, the optical intensity of the backlights 4*a*, 4*b* is regulated. Alternatively, the luminance of the image display in the front passenger seat display area 3 may be rendered lower than the luminance of the image display in the driver seat display area 2 by regulating the optical intensity of only either one of the backlights. Specifically, the luminance of the image display in the front passenger seat display area 3 may be rendered lower than the luminance of the image display in the driver seat display area 2 by decreasing the output optical intensity of the backlight 4*b* rather than by regulating the output optical intensity of the backlight 4*a*. Conversely the luminance of the image display in the front passenger seat display area 3 may be rendered lower than the luminance of the image display in the driver seat display area 2 by increasing the output optical intensity of the backlight 4*a* rather than by regulating the output optical intensity of the backlight 4*b*.

In the above configuration, the optical intensity regulation section 11 retrieves optical intensity regulation data T1, T2 from the LUT 12 if the differential value A2-A1 is positive. The section 11 may do so regardless of the differential value A2-A1. For example, combinations of output optical intensity regulation data T1, T2 are recorded in the LUT 12 in association with combinations of a mean luminance level A2 and a mean luminance level A1. Receiving the mean luminance level A2 and the mean luminance level A1 without letting the levels going through the differential value computing section 10, the optical intensity regulation section 11 refers to the LUT 12 to retrieve optical intensity regulation data T1, T2 associative with the input mean luminance level A2 and mean luminance level A1. The optical intensity regulation data T1 is then fed to the backlight control circuit 6*a*. The optical intensity regulation data T2 is fed to the backlight control circuit 6*b*.

In short, the optical intensity regulation section 11 retrieves optical intensity regulation data T1, T2 in accordance with the mean luminance level A2 and the mean luminance level A1 and feeds the retrieved optical intensity regulation data T1, T2 to the backlight control circuits 6*a*, 6*b*, so as to regulate the optical intensity of the backlights 4*a*, 4*b*. The optical intensity regulation section 11 thereby corrects to limit the luminance of the image display in the front passenger seat display area 3 further than the luminance of the image display in the driver seat display area 2.

In the above configuration, the pixel values in the image data and the luminance level calculated from pixel values are given by 8-bit digital signals. This is not the only possibility. The digital signals may be of a different bit.

In the above configuration, luminance is given as from level 0 (black) to level 255 (white). Luminance increases with an increase in the luminance level. Alternatively, luminance level may be defined as from 0 (white) to 255 (black) so that luminance can increase with a decrease in the luminance level. In the latter event, it is when the differential value A2-A1 is negative that the optical intensity regulation section 11 refers to the LUT 12, retrieves optical intensity regulation data T1, T2 from the LUT 12 associated with the differential value A2-A1, and feeds the retrieved optical intensity regulation data T1, T2 to the backlight control circuits 6*a*, 6*b*. This is because when the differential value A2-A1 is negative, the luminance of the image display in the front passenger seat display area 3 can be safely regarded higher than the luminance of the image display in the driver seat display area 2.

In the above configuration, the driver seat display area 2 and the front passenger seat display area 3 are provided on the single display panel 1. Alternatively, the driver seat display area 2 and the front passenger seat display area 3 may be provided on individual display panels.

In the above configuration, the output optical intensity of the backlights 4*a*, 4*b* is regulated according to the mean luminance level A1 and the mean luminance level A2. This is not the only possibility. Alternatively, the output optical intensity may be regulated in accordance with medians, as an example. Specifically, the median (second luminance level) M1 is calculated for the luminance of the pixels forming an image display in the driver seat display area 2. Also, the median (first luminance level) M2 is calculated for the luminance of the pixels forming an image display in the front passenger seat display area 3. The median M1 is then subtracted from the median M2. If the differential value M2-M1 is positive, the section 11 refers to the LUT 12 to retrieve optical intensity regulation data T1', T2' associated with the differential value M2-M1 from the LUT 12. The retrieved optical intensity regulation data T1', T2' is then fed to the backlight control circuits 6*a*, 6*b*.

Alternatively, a maximum (second luminance level) H1 is determined in the luminance of the pixels forming the image display in the driver seat display area 2. Also, a maximum (first luminance level) H2 is determined in the luminance of the pixels forming the image display in the front passenger seat display area 3. The maximum H1 is then subtracted from the maximum H2. If the differential value H2-H1 is positive, the section 11 refers to the LUT 12 to retrieve optical intensity regulation data T1", T2" associated with the differential value H2-H1 from the LUT 12. The retrieved optical intensity regulation data T1", T2" is then fed to the backlight control circuits 6*a*, 6*b*.

To sum it up, there are different kinds of means available which outputs the luminance level of the image display for the driver seat display area 2 (second luminance level) and the luminance level of the image display for the front passenger seat display area 3 (first luminance level): (a) The second luminance level is the mean luminance level A1. The first luminance level is the mean luminance level A2. (b) The second luminance level is the median M1. The first luminance level is the median M2. (c) The second luminance level is the maximum H1. The first luminance level is the maximum H2.

A parameter calculated from two or more of the three factors, i.e., the mean, median, and maximum of the luminance levels of the pixels forming the image display, may be used as the luminance level of the image display.

The mean luminance levels A1, A2, the medians M1, M2, and the maximums H2, H1 may be calculated either from all the pixels forming the image display or from only predetermined ones of those pixels.

Figure 5:
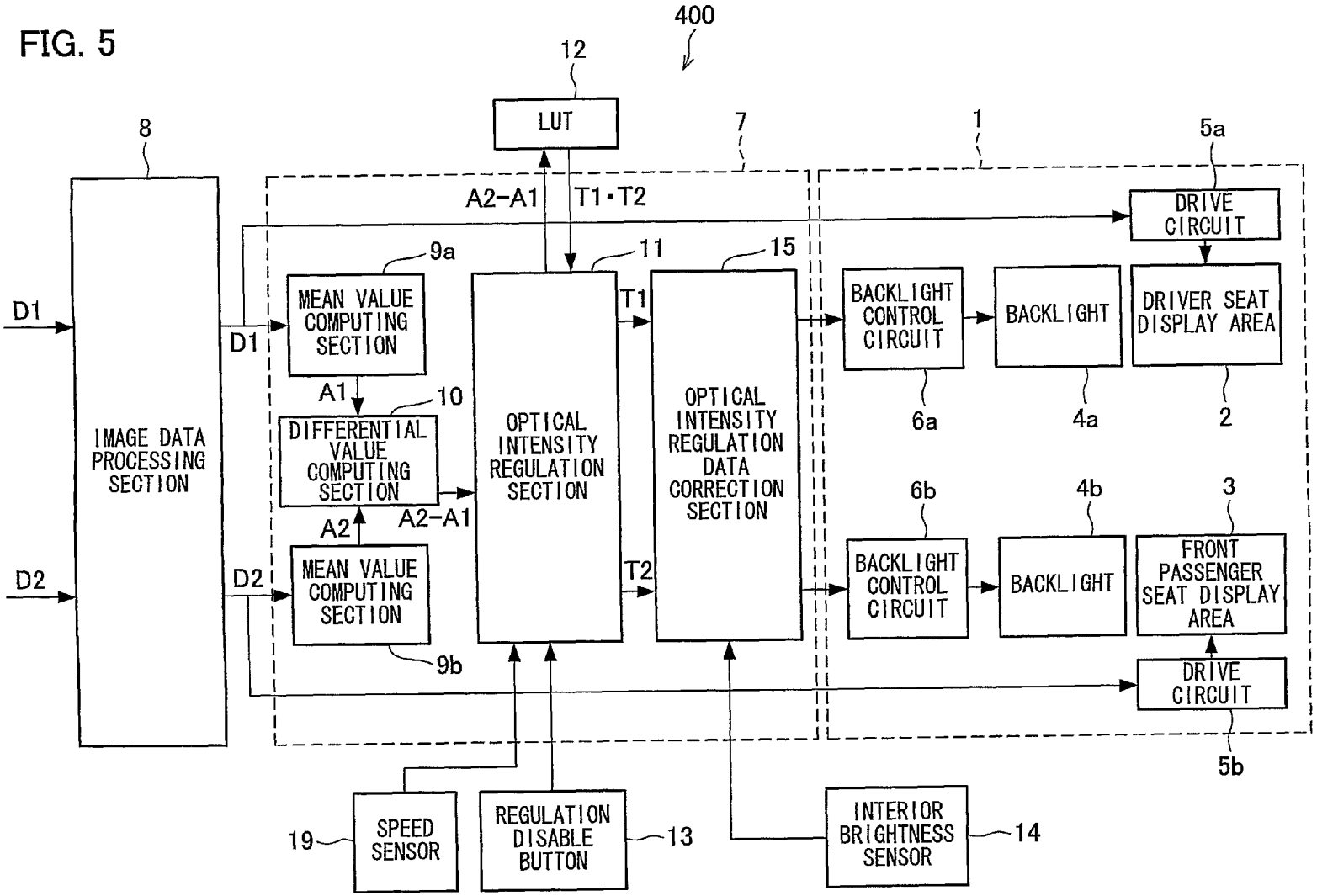
FIG. 5 is a block diagram schematically illustrating the configuration of a liquid crystal display device in accordance with another embodiment of the present invention.

In the above configuration, a configuration may be added in which the luminance of the driver seat display area 2 and that of the front passenger seat display area 3 are uniformly regulated in accordance with brightness inside the automobile. For example, as shown in FIG. 5, the liquid crystal display device 400 may include an interior brightness sensor (brightness detecting means) 14 and an optical intensity regulation data correction section 15. The sensor 14 senses brightness inside the automobile. The section 15 uniformly corrects the optical intensity regulation data in accordance with an output of the interior brightness sensor 14. Brightness inside the automobile is optical intensity inside the automobile. That is, in this situation, sensing brightness means sensing optical intensity.

Figure 6:
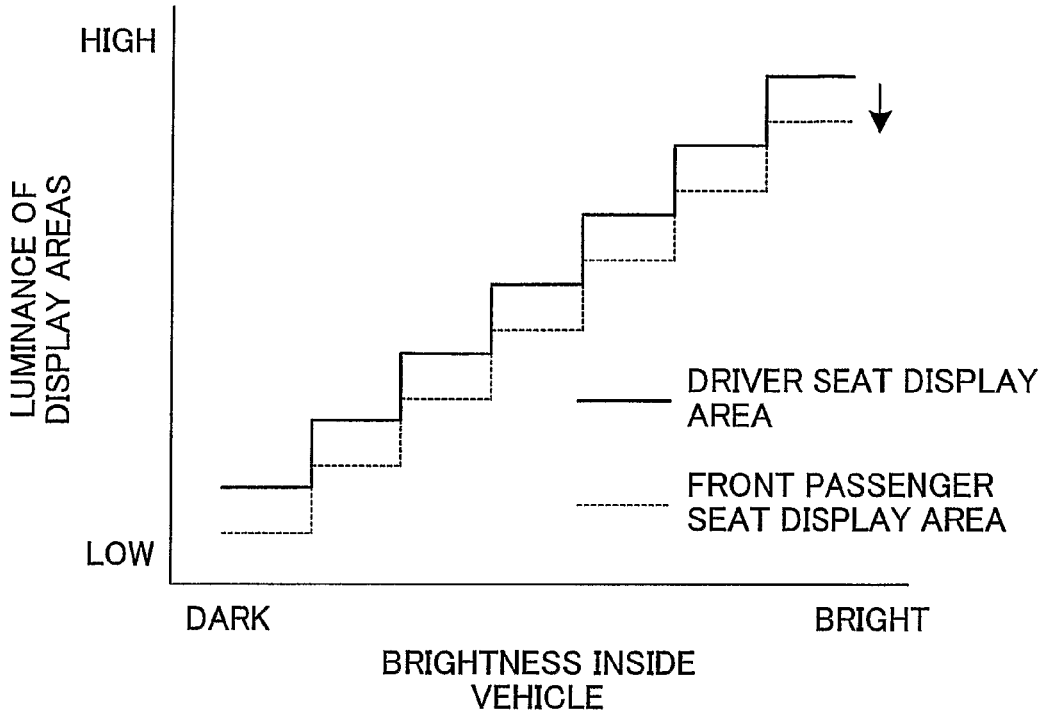
FIG. 6 is a graph representing brightness inside an automobile vs. luminance of images shown in display areas as achieved by an optical intensity regulation data correction section shown in FIG. 5.

The optical intensity regulation data correction section 15 uniformly corrects the optical intensity regulation data T1, T2. The correction results in the luminance of the driver seat display area 2 and the front passenger seat display area 3 uniformly increasing with an increase in brightness inside the automobile as shown in FIG. 6. The uniform increase renders the luminance of the image display in the front passenger seat display area 3 lower than the luminance of the image display in the driver seat display area 2. Also, the uniform increase retains high visibility for the image display in the driver seat display area 2 and the image display for the front passenger seat display area 3 regardless of the environmental conditions of the automobile (nighttime or daytime, outside or inside a tunnel, etc.).

In the above configuration, the automatic luminance regulation for the driver seat display area 2 and the front passenger seat display area 3 may be disabled by disabling the optical intensity regulation section 11 in response to an instruction from a passenger. For example, as shown in FIG. 5, there is provided a luminance regulation disable button (luminance regulation disable means) 13 in a liquid crystal display device 400. The luminance regulation disable button 13 provides an interface where the driver or a fellow passenger enters an instruction disabling the optical intensity regulation section 11. The luminance regulation disable button 13, when pressed by the driver or a fellow passenger, suspends the operation of the optical intensity regulation section 11. The suspension precludes a change in the luminance of the front passenger seat display area 3. If the fellow passenger wants to continuously view the image display produced in the front passenger seat display area 3, he/she can do so at the same luminance.

Figure 7:
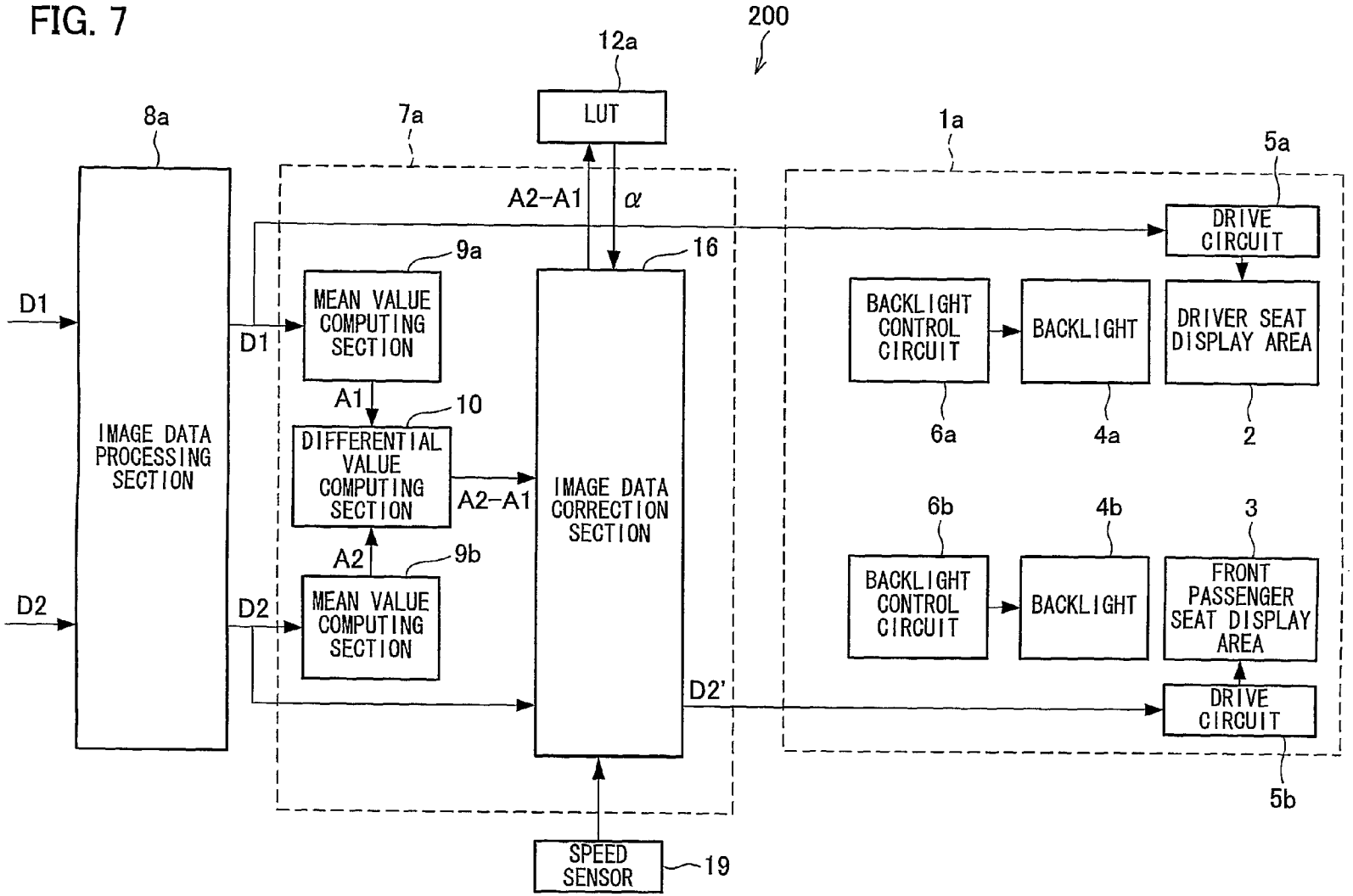
FIG. 7 is a block diagram schematically illustrating the arrangement of a liquid crystal display device in accordance with a further embodiment of the present invention.

The luminance of the image display in the front passenger seat display area 3 may be rendered lower than the luminance of the image display in the driver seat display area 2 by correcting the image data D2 rather than by regulating the output optical intensity of the backlights 4*a*, 4*b*. FIG. 7 shows a configuration example of a liquid crystal display device 200 for the latter case. FIG. 7 differs from FIG. 1 in that the optical intensity regulation section 11 is replaced by an image data correction section 16 in a display luminance control section 7*a*.

The image data correction section (luminance limiting means) 16 receives the differential value A2-A1 from the differential value computing section 10 and the image data D2 from the image data processing section 8*a*. The image data correction section 16, if the differential value A2-A1 is positive, refers to the LUT 12*a* to retrieve a correction value $\alpha$ associated with the differential value A2-A1. The section 16 corrects the pixel values contained the image data D2 based on the correction value $\alpha$. The section 16 outputs the corrected image data D2' to the drive circuit 5*b*. The correction value $\alpha$ associated with the differential value A2-A1 is a luminance correction value based on which are corrected the pixel values contained in the image data D2 indicating the mean luminance level A2. After the correction, the luminance of the image display produced based on the corrected image data is lower than the luminance of the image display produced based on the mean luminance level A1.

The drive circuit 5*a* drives the pixels in the driver seat display area 2 in accordance with the image data D1. The drive circuit 5*b* drives the pixels in the front passenger seat display area 3 in accordance with the image data D2' given by the image data correction section 16. These actions renders the luminance of the image display in the front passenger seat display area 3 lower than the luminance of the image display in the driver seat display area 2.

In the FIG. 7 configuration, the image data correction section 16 corrects the pixel values contained in the image data D2 according to the correction value $\alpha$. Alternatively, the section 16 may correct the pixel values contained in the image data D1, to render the luminance of the image display in the front passenger seat display area 3 lower than the luminance of the image display in the driver seat display area 2.

In the FIG. 7 configuration, the image data is corrected, rather than the optical intensity of the backlights 4*a*, 4*b* are regulated, to render the luminance of the image display in the front passenger seat display area 3 lower than the luminance of the image display in the driver seat display area 2. Therefore, the FIG. 7 configuration is feasible with no backlight. The configuration is applicable to reflective liquid crystal displays, CRT (Cathode Ray Tube) displays, organic EL (electroluminescent) displays, inorganic EL displays, and plasma displays.

Figure 8:
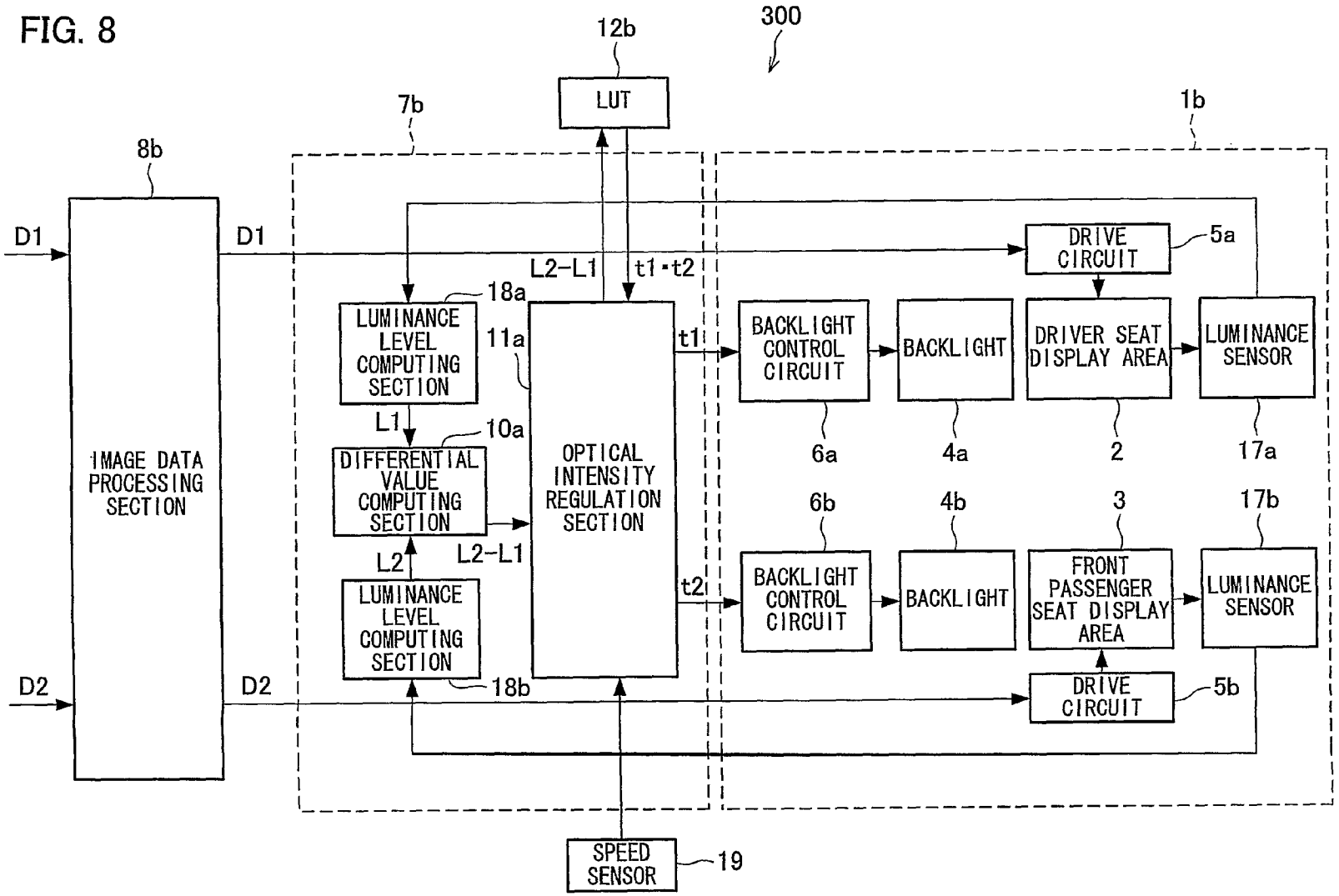
FIG. 8 is a block diagram schematically illustrating the arrangement of a liquid crystal display device in accordance with still another embodiment of the present invention.

The output optical intensity of the backlights 4*a*, 4*b* is regulated based on the mean luminance level A1 and the mean luminance level A2 in the foregoing description. Alternatively, the output optical intensity of the backlights 4*a*, 4*b* may be regulated based on the luminance as detected by luminance sensors provided to the display areas 2, 3. FIG. 8 shows a configuration example of a liquid crystal display device 300 for the alternative case. FIG. 8 differs from FIG. 1 in that the mean value computing sections 9*a*, 9*b* are replaced by a luminance sensor 17*a*, a luminance sensor 17*b*, a luminance level computing section 18*a*, and a luminance level computing section 18*b*. The luminance sensor 17*a* detects the luminance of the image display in the driver seat display area 2. The luminance sensor 17*b* detects the luminance of the image display in the front passenger seat display area 3. The luminance level computing section, or second luminance level output means, 18*a* quantifies the luminance detected by the luminance sensor 17*a* for output. The luminance level computing section, or first luminance level output means, 18*b* quantifies the luminance detected by the luminance sensor 17*b* for output.

In the FIG. 8 configuration, the luminance level computing section 18*a* quantifies the luminance of the image display in the driver seat display area 2 for output as a luminance level (second luminance level) L1. The luminance level computing section 18*b* quantifies the luminance of the image display in the front passenger seat display area 3 for output as a luminance level (first luminance level) L2. The differential value computing section 10*a* then subtracts the luminance level L1 from the luminance level L2 for output as a differential value L2-L1. If the differential value L2-L1 is positive, the optical intensity regulation section 11*a* refers to the LUT 12*b* to retrieve optical intensity regulation data T1, T2 associated with the differential value L2-L1. The optical intensity regulation data t1 is fed to the backlight control circuit 6*a*. The optical intensity regulation data t2 is fed to the backlight control circuit 6*b*. The optical intensity regulation data T1, T2 recorded in the LUT 12*b* gives output optical intensities for the backlights 4*a*, 4*b*. The backlights 4*a*, 4*b* at such output intensities results in an image display being produced at the luminance level L1 in the driver seat display area 2 and at the luminance level L2 in the front passenger seat display area 3. The luminance of the image display in the front passenger seat display area 3 is lower than the luminance of the image display in the driver seat display area 2. The optical intensity regulation data t1 indicates the output optical intensity for the backlight 4*a*. The optical intensity regulation data t2 indicates the output optical intensity for the backlight 4*b*. Accordingly, luminance is automatically corrected so that the luminance of the front passenger seat display area 3 is lower than the luminance of the driver seat display area 2.

The liquid crystal display device in accordance with the present embodiment is mounted to the automobile. This is by no means limiting the invention. The liquid crystal display device in accordance with the present embodiment may be mounted to any mode of transport equipped with a seat for an operator and another for a front passenger. Examples such a mode of transport include railroad trains, private aircraft, and private vessels.

The display panel 1 in accordance with the present embodiment has an aspect ratio of 7:3 or greater, measuring greater in width than in height. This is by no means limiting the invention. At an aspect ratio greater than 7:3, however, the display panel 1 provides improved visibility in a simultaneously display of an image giving driving information on the automobile and a fellow passenger image. To describe it in more detail, the aspect ratio may be set to 8:3, 30:9, 32:9, etc. Such display panels 1 can be built by combining two panels with an aspect ratio 4:3, 15:9, 16:9, etc.

A liquid crystal display device in accordance with the present embodiment is characterized in that a first display area and a second display area are provided on a transmissive liquid crystal display device, with separate backlights for each of the display areas. It is also characterized in that the luminance limiting means regulates the output optical intensity of one of the backlights which corresponds to the first display area and/or the output optical intensity of the other one of the backlights which corresponds to the second display area.

According to the arrangement, the first and second display areas are provided on a transmissive liquid crystal display device. Separate backlights are provided for each display area. The output optical intensity of the backlight which corresponds to the first display area can be rendered different from the output optical intensity of the backlight which corresponds to the second display area by regulating the output optical intensity of the backlight which corresponds to the first display area and/or the output optical intensity of the backlight which corresponds to the second display area. Thus, the luminance of the image display produced in the first display area can be further limited than the luminance of the image display produced in the second display area by regulating the optical intensity of the backlights.

Another liquid crystal display device in accordance with the present embodiment is characterized in that, in addition to the configuration, the first luminance level output means calculates the first luminance level according to image data for the image display produced in the first display area, and the second luminance level output means outputs the second luminance level according to image data for the image display produced in the second display area.

The first luminance level refers to the luminance of the image display produced in the first display area. The second luminance level refers to the luminance of the image display produced in the second display area. Therefore, the first and second luminance levels can be readily output if the image data for the image display produced in the first display area and the image data for the image display produced in the second display area. Incidentally, the first and second luminance levels may be, for example, the mean value of luminance levels for the pixels forming an image as calculated from image data, the median of luminance levels for the pixels forming an image as calculated from image data, or the maximum of luminance levels for the pixels forming an image as calculated from image data.

A display device in accordance with the present invention, as described in the foregoing, includes: first luminance level output means outputting a first luminance level representing luminance of an image display produced in a first display area; second luminance level output means outputting a second luminance level representing luminance of an image display produced in a second display area; and luminance limiting means correcting according to the first luminance level and the second luminance level so that the luminance of the image display produced in the first display area is further limited than the luminance of the image display produced in the second display area. With the display device, illumination in the first display area no longer glares relative to the second display area which is closer to the operator's position than is the first display area. This in turn ensures, for the operator, good visibility of the display in the second display area which is closer to the operator's position than is the first display area.

Incidentally, the display device may be provided in the form of hardware. Alternatively, the device may be provided in the form of a program executed on a computer. Specifically, a computer program controlling the display device in accordance with the present invention causes a computer to execute the foregoing method of controlling a display device. A computer, upon the execution of the program, can control a display device by the method of controlling a display device.

In other words, in the embodiment, the blocks, or components of a display luminance control section, may be provided entirely by means of hardware. Alternatively, the blocks may be provided entirely or partly by a combination of a computer program providing the aforementioned functions and hardware (computer) executing the program. An example of such a display luminance control section is a computer being connected to a liquid crystal display device to act as a device driver driving the liquid crystal display device. In addition, if the display luminance control section can be provided as an built-in or external conversion board to the liquid crystal display device, and the operation of the circuitry providing the display luminance control section is alterable by rewriting firmware or another computer program, the software may be distributed to alter the operation of the circuitry so that the circuitry can operate as the display luminance control section in accordance with the embodiment.

In these cases, if hardware capable of executing the aforementioned functions is prepared, the display luminance control section in accordance with the embodiment can be realized simply by having the hardware execute the computer program.

The embodiments and examples described in Best Mode for Carrying Out the Invention are for illustrative purposes only and by no means limit the scope of the present invention. Variations are not to be regarded as a departure from the spirit and scope of the invention, and all such modifications as would be obvious to one skilled in the art are intended to be included within the scope of the claims below.

INDUSTRIAL APPLICABILITY

The display device in accordance with the present invention is mounted where it is visible from the driver seat and a front passenger seat in a mode of transport. The invention is applicable to, for example, the automobile, the railroad trains, aircraft, and vessels.

The invention claimed is:

1. A display device mounted to a mode of transport comprising:

a first display area that is fixed with respect to the display device; and a second display area that is fixed with respect to the display device, that is separate from the first display area, and that is closer to a position of an operator than is the first display area when the display device is mounted to the mode of transport;

a first luminance level output section arranged to output a first luminance level representing luminance of an image display produced in the first display area;

a second luminance level output section arranged to output a second luminance level representing luminance of an image display produced in the second display area; and a luminance limiting section arranged to limit, according to the first luminance level and the second luminance level, the luminance of the image display produced in the first display area to be less than the luminance of the image display produced in the second display area; wherein the first and second display areas are provided on a transmissive liquid crystal display device with separate backlights for each of the display areas; and the luminance limiting section regulates output optical intensity of at least one of the separate backlights, and the luminance level of the first display area is non-zero.

2. The display device as set forth in claim 1, wherein the first and second display areas are both provided on a single transmissive liquid crystal display device.

3. The display device as set forth in claim 1, further comprising:

a brightness detecting section arranged to sense brightness inside the mode of transport; and an optical intensity regulation data correction section arranged to correct optical intensity regulation data according to an output of the brightness detecting section; wherein the luminance limiting section uses the optical intensity regulation data to regulate the output optical intensity of the separate backlights.

* * * * *